US006674351B2

(12) United States Patent
Koch-Groeber et al.

(10) Patent No.: US 6,674,351 B2
(45) Date of Patent: Jan. 6, 2004

(54) ELECTROMAGNET WITH A MAGNET ARMATURE

(75) Inventors: Hermann Koch-Groeber, Stuttgart (DE); Rainer Stoehr, Stegaurach (DE); Michele De Cosmo, Naples (IT); Nicola Pacucci, Bari (IT); Petr Vosahlo, Jihlava (CZ)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/204,763

(22) PCT Filed: Dec. 20, 2001

(86) PCT No.: PCT/DE01/04833

§ 371 (c)(1),
(2), (4) Date: Feb. 25, 2003

(87) PCT Pub. No.: WO02/052587

PCT Pub. Date: Jul. 4, 2002

(65) Prior Publication Data

US 2003/0160671 A1 Aug. 28, 2003

(30) Foreign Application Priority Data

Dec. 23, 2000 (DE) ..... 10065016

(51) Int. Cl.[7] ..... H01F 7/16

(52) U.S. Cl. ..... 335/263; 335/262; 335/273; 251/129.16

(58) Field of Search ..... 123/458; 335/255, 335/258, 261, 262, 263, 270, 273, 279, 281; 251/129.01, 129.15, 129.16

(56) References Cited

U.S. PATENT DOCUMENTS 5,476,079 A * 12/1995 Kanamori et al. ..... 123/458

FOREIGN PATENT DOCUMENTS

| | | |
|---|---|---|
| DE | 44 43 004 | 6/1995 |
| WO | WO 00 33329 | 6/2000 |

* cited by examiner

*Primary Examiner*—Ramon M. Barrera
(74) *Attorney, Agent, or Firm*—Kenyon & Kenyon

(57) ABSTRACT

In an electromagnet having an armature, in particular for use in a solenoid valve, which includes a solenoid coil, a magnet core which passes through the solenoid coil and has at least one pole face, an armature which is supported perpendicularly to the at least one pole face of the magnet core so as to be able to slide and has an armature plate facing the pole face and an armature pin that projects from the armature plate and is supported so as to be able to slide and rotate, and an adjusting arrangement that is formed on the electromagnet and/or on the armature and adjust the armature plate to a predetermined rotational position, it is proposed that at least one first cutout which is radially offset from the armature pin and formed in the armature plate, and at least one second cutout which is situated in the at least one pole face of the magnet core and assigned to the first cutout, be provided as adjusting arrangement; the second cutout magnetically interacting with the first cutout in response to the solenoid coil being acted upon by a current, such that the armature plate is adjusted to the predetermined rotational position.

9 Claims, 4 Drawing Sheets

PRIOR ART

ELECTROMAGNET WITH A MAGNET ARMATURE

FIELD OF THE INVENTION

The present invention relates to an electromagnet having an armature.

BACKGROUND INFORMATION

Known electromagnets having an armature are used, for example, in solenoid valves of pressure-regulating valves for injection systems of internal combustion engines. Such solenoid valves have electrical connector elements, which are led from a side of the armature opposite the electromagnet, through an opening of the armature plate, and are contacted to the solenoid coil. In order to prevent the connector elements from coming in contact with the inner wall of the armature-plate opening upon activation of the electromagnet, and impairing the movement of the armature plate through friction, the known electromagnets have mechanical adjusting arrangement in the form of a guide pin and a groove in the armature plate that interacts with the guide pin, the adjusting arrangement adjusting the armature plate to a predetermined angle of rotation and preventing the armature plate from rubbing against the electrical connector elements of the solenoid coil. However, it is disadvantageous that the mechanical adjusting arrangement can impair the movement of the armature.

SUMMARY OF THE INVENTION

The present invention's electromagnet having an armature eliminates the disadvantages associated with the use of mechanical adjusting arrangement. When a current acts on the solenoid coil, at least one cutout in the armature plate and a second opening in the pole face of the magnet core, which is assigned to the first opening, allow magnetic forces to adjust the armature plate to a predetermined rotational position, in which, for example, the connector elements pass through a cutout of the armature plate without touching it. Therefore, one may advantageously dispense with the design of mechanical adjusting arrangement that are expensive to manufacture. The stray magnetic flux in the region between the inner-wall segments of the at least one cutout and the at least one second cutout advantageously creates a frictionless design of the armature plate and the armature. In the case of a minimal rotation of the armature plate about the armature pin, restoring forces, which act on the armature plate and drive the armature back into its predetermined rotational position, result from the nonuniformity of the magnetic field.

The present invention introduced here may advantageously be used in pressure-regulating valves, in order to prevent frictional losses of the armature and impairment of the closing operation of the solenoid valve. In addition, the present invention may also be used in solenoid valves for injection valves of internal combustion engines, where the armature is adjusted in order to, for example, keep the cross-section of the fuel discharge channels running through cutouts of the armature from narrowing in response to rotation of the armature. However, the present invention is in no way limited to use in solenoid valves, and may be used in all electromagnets having an armature, where an armature plate, which is supported so as to be able to slide and rotate, has to be adjusted to a preferred angular position.

DETAILED DESCRIPTION

Figure 1:
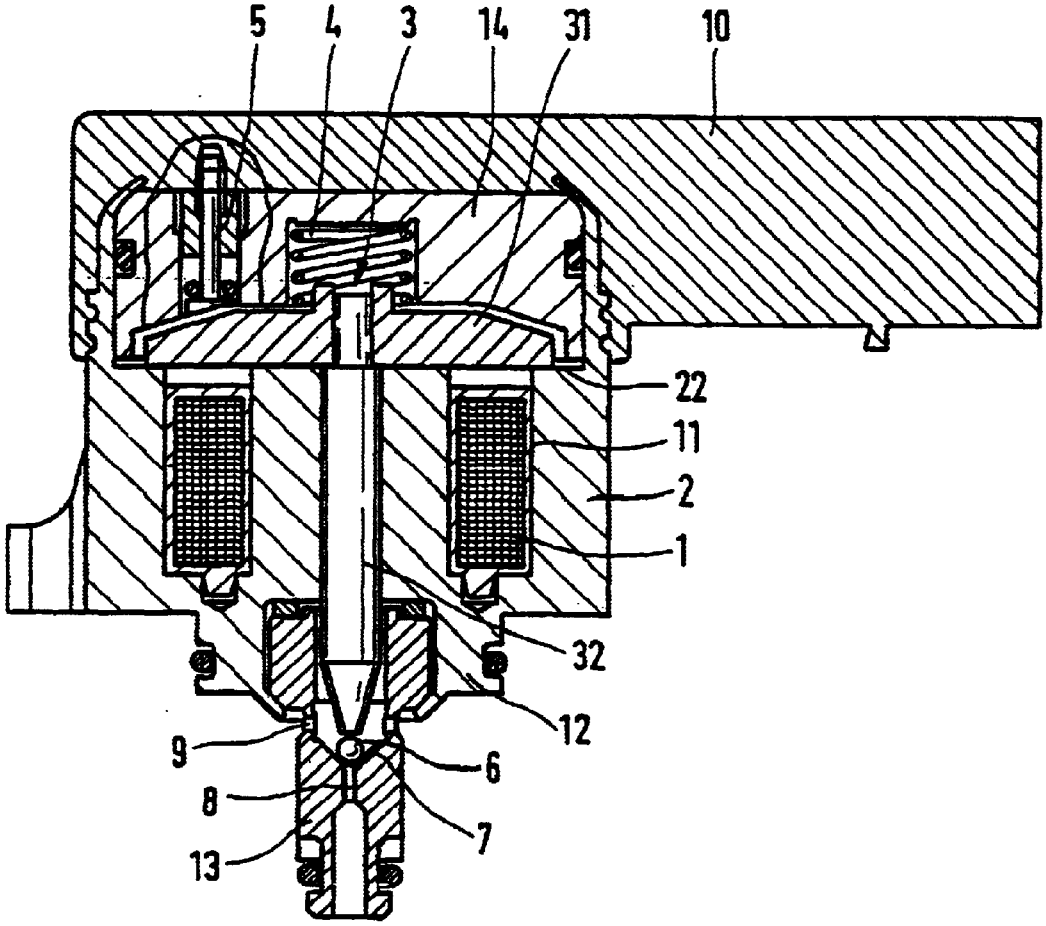
FIG. 1 shows a pressure-regulating valve known from the related art, having an electromagnet and an armature.
Figure 2:
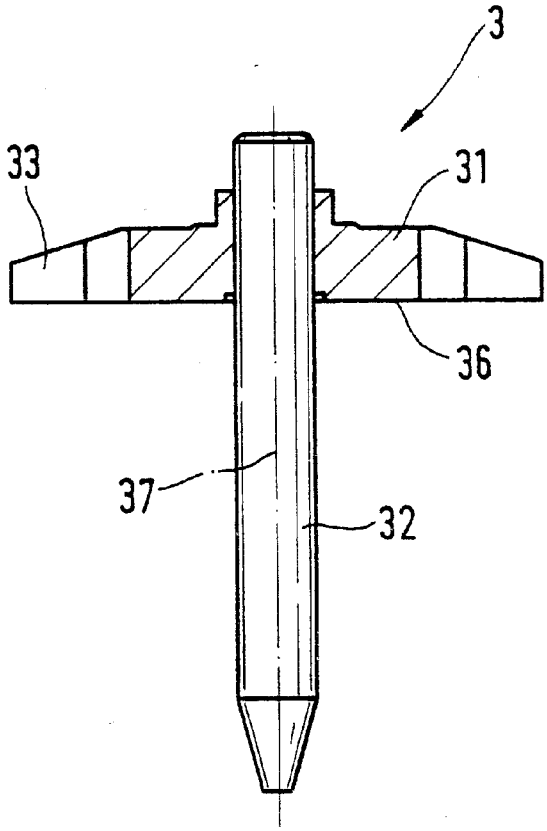
FIG. 2 shows a first illustration of an armature according to the present invention.

FIG. 1 shows a pressure-regulating valve known in the related art, which is used, for example, in fuel-injection systems of internal combustion engines, in order to set the pressure in a high-pressure fuel reservoir as a function of the load status of the engine. The pressure-regulating valve has a flange region 12 for connection to a high-pressure fuel pump or a high-pressure fuel reservoir. A valve piece 13 inserted into flange region 12 of the pressure-regulating valve has a fuel inlet port 8, which is connected to the high-pressure side, and whose one end leads into a valve seat 7 of valve piece 13. Lateral openings 9 of valve piece 13 are connected to a fuel return line in a manner not represented in further detail. An electromagnet controls the opening and closing of the pressure-regulating valve. As can be seen in FIG. 1, the electromagnet has a magnet core 2, which is approximately cylindrical in the cross-sectional view and simultaneously forms a housing part of the pressure-regulating valve. A solenoid coil 1 is situated in an annular recess 11 of the magnet core. In addition, the electromagnet has an armature 3 possessing armature plate 31 and armature pin 32, the armature pin engaging with a cylindrical through-hole of magnet core 2 so as to be able to slide and rotate. The end of armature pin 32 facing away from armature plate 31 interacts with a valve member 6 that takes the form of a ball. Armature pin 31, along with valve member 6, is acted upon by a spring 4, whose one end is supported at housing part 14 of the pressure-regulating valve, and whose other end is supported at armature plate 31. The tensional force of spring 4, which acts on the armature pin in the direction of valve seat 7, acts in opposition to the high-pressure force in fuel inlet port 8 in such a manner, that the pressure-regulating valve is opened and the fuel flows through openings 9, when the electromagnet is not switched on and the system pressure is low. When a current acts on the electromagnet, the armature plate is pulled by the electromagnet, and armature pin 32 presses valve member 6 into valve seat 7, so that fuel inlet port 8 is closed until a force equilibrium is achieved between, on one hand, the high-pressure force and, on the other hand, the magnetic force and spring force.

As is apparent from FIG. 1, the pressure-regulating valve has electrical connector elements 5, which connect an electrical connecting part 10 of the pressure-regulating valve to solenoid coil 1. Since armature plate 31 is situated between connecting part 10 and solenoid coil 1, the electrical connector elements 5 have to pass through a cutout in armature plate 31, which is not shown. When armature plate 31 rotates about the axis of armature pin 32, the connector elements provided with a plastic covering disadvantageously rub against the inner wall of the armature-plate cutout. For this reason, the electromagnets known in the related art use mechanical adjusting arrangement, which adjusts the armature plate to a predetermined rotational position but allow the armature plate to move perpendicularly to pole face 22 of the electromagnet. Thus, it is, for example, known that, in order to adjust the armature plate to a predetermined rotational position, a pin is provided, which projects from pole face 22 of the magnet core and engages with a groove in armature plate 31 with a slight amount of play. In the predetermined rotational position of the armature plate, the connector elements reach through the armature plate without making contact with it.

An exemplary embodiment of the present invention is represented in FIGS. 2 through 7. However, the present invention is not restricted to use in pressure-regulating valves or solenoid valves, but may be used in all electromagnets having an armature, where it is desirable for the armature to be adjusted to a predetermined rotational position. The armature 3 represented in FIGS. 2 and 3 includes an essentially circular armature plate 31 and an armature pin 32, which projects perpendicularly from the armature plate and has a circular cross-section. An opening 35 in the armature plate is used to feed through electrical connector elements of a solenoid coil. As is also apparent from FIG. 2 and FIG. 3, the armature plate has two first, approximately U-shaped, through-cutouts 33, whose open ends are situated on the circumference of the armature plate, and which are diametrically opposed with respect to armature pin 32.

Figure 4:
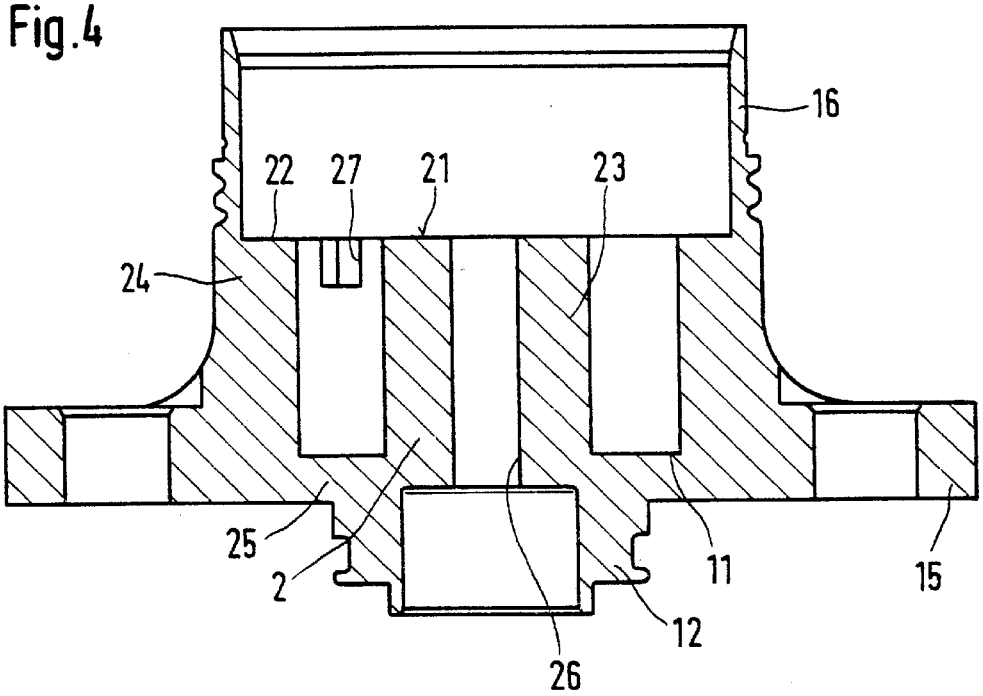
FIG. 4 shows a first illustration of a magnet core of the electromagnet according to the present invention, which simultaneously forms a housing part of a pressure-regulating valve.
Figure 5:
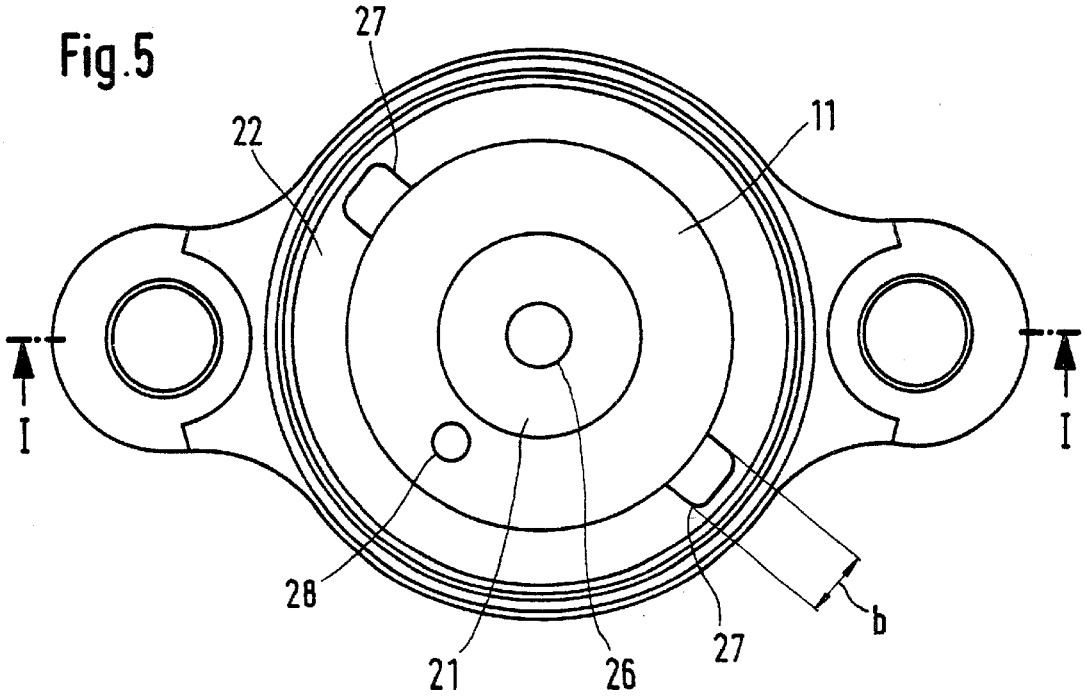
FIG. 5 shows a second illustration of a magnet core of the electromagnet according to the present invention, which simultaneously forms a housing part of a pressure-regulating valve.

A cup-shaped housing part of a pressure-regulating valve is represented in FIG. 4 and FIG. 5. FIG. 4 shows a cross-section of FIG. 5 along line I—I. The housing part has a cylindrical mid-section that forms magnet core 2, as well as lateral attachment tabs 15 for fastening the pressure-regulating valve to, e.g. a high-pressure fuel pump. The magnet core is preferably made of soft iron or another material having a high permeability. As shown in FIG. 1, a flange region 12 of the housing part is used for receiving a valve piece, as well as for connection to a high-pressure outlet of a high-pressure fuel pump. The cylindrical mid section has a central, cylindrical through-hole 26 and an annular recess 11, which is concentric to it and is used to receive a solenoid coil not shown in FIG. 4. Electrical connection 28 of solenoid coil 1 is schematically sketched in FIG. 5. In the radial direction, recess 11 is bound on the inside by a first, cylindrical, shell-shaped wall 23 and bound on the outside by a second, cylindrical, shell-shaped wall 24. The ends of first wall 21 and second wall 24 facing away from flange region 12 form two annular, concentric surfaces 21 and 22 situated in one plane. A circular collar 16 projecting from surface 22 is used to accommodate a second housing part 14, as is shown in FIG. 1.

When the solenoid coil is inserted into recess 11, inner wall 23 forms a segment of the magnet core 2, which passes through the coil and is connected to an outer wall segment 24 of the magnet core by a bottom plate 25, the outer wall segment encircling the coil. In this context, the two surfaces 21, 22 form two pole faces of magnet core 2, so that the magnetic circuit is closed by an armature plate 31 placed on the two pole faces 21, 22. As can be seen most effectively in FIG. 5, two cutouts 27, which are assigned to first cutouts 33 in armature plate 31 and are diametrically opposed with respect to through-hole 26, are situated in outer pole face 22 of the magnet core.

Figure 6:
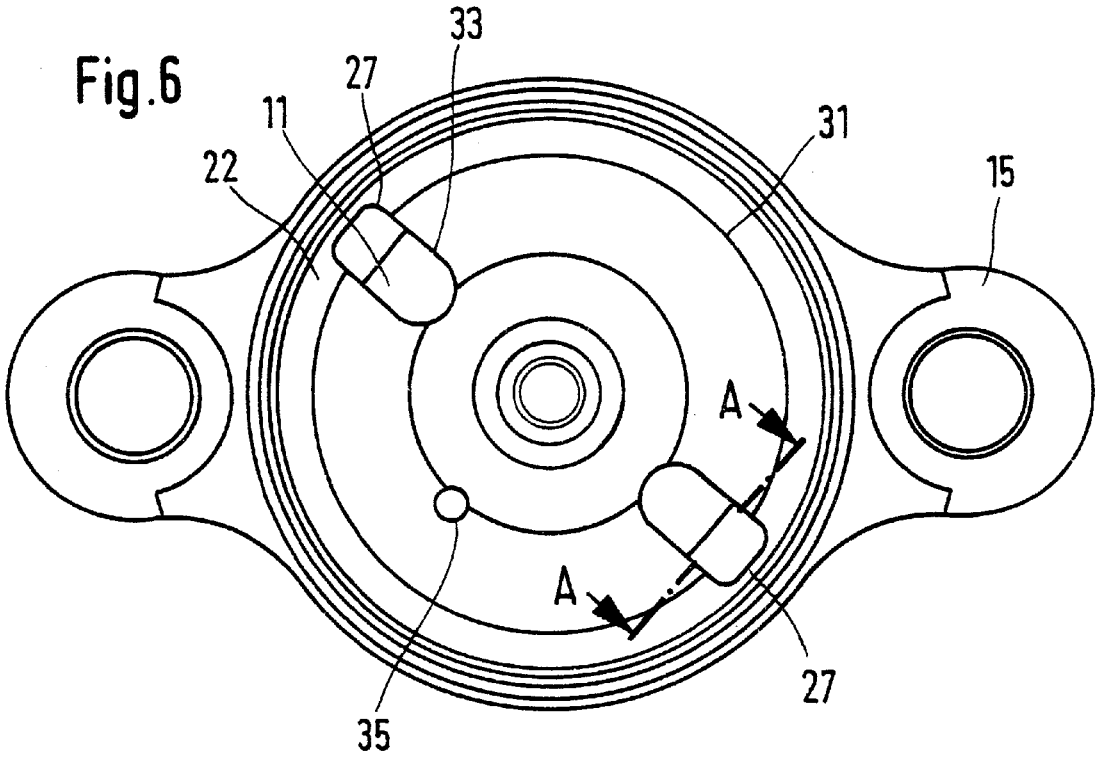
FIG. 6 shows the magnet core and armature from FIG. 3 and FIG. 5, in the assembled state.

FIG. 6 shows the magnet core without the solenoid coil, but with the armature inserted. Using armature pin 32, the armature is inserted into cylindrical through-hole 26 so as to be able to slide and, initially, rotate. In a preferred rotational position of armature plate 31, connection 28 of the solenoid coil from FIG. 5 lies in the projection of recess 35 of armature plate 31, in the sliding direction of armature 3. In this rotational position, electrical connector elements may pass through armature plate 31 in a straight line, parallelly to armature pin 32, without rubbing against the inner edges of opening 35. First cutouts 33 and second cutouts 27 are used to adjust the rotational position during the operation of the electromagnet.

Figure 3:
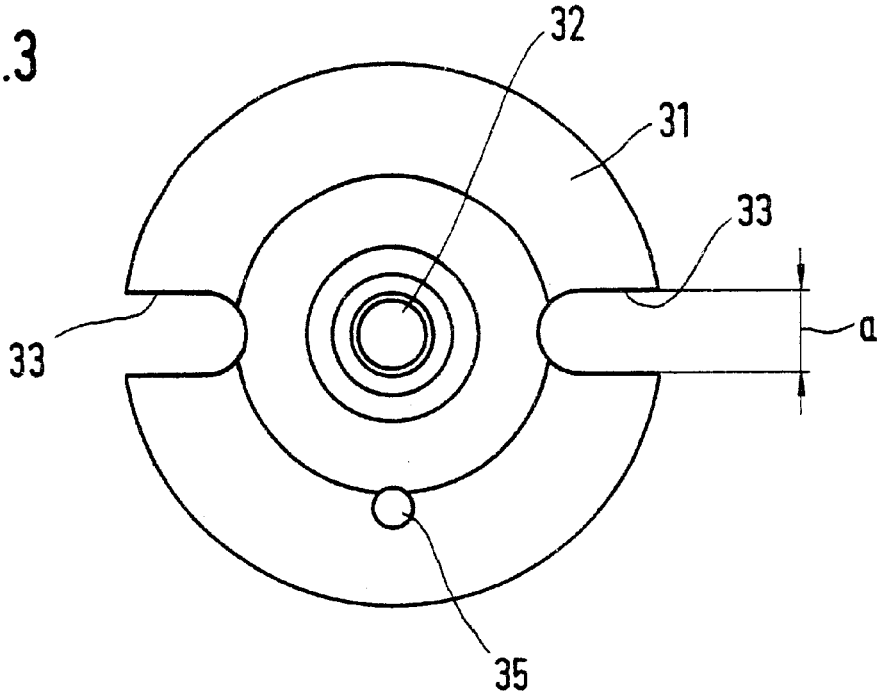
FIG. 3 shows a second illustration of an armature according to the present invention.
Figure 7:
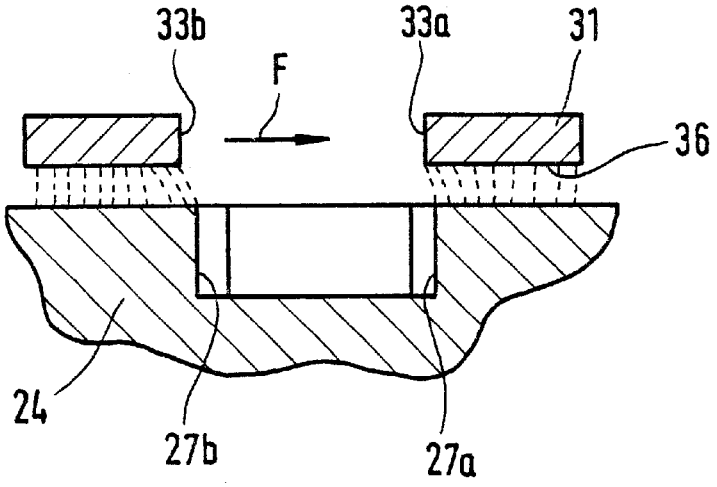
FIG. 7 shows a section through FIG. 6, along line A—A, in the case of the armature being slightly deflected.

As can be easily seen in FIG. 6 and FIG. 7 in conjunction with FIG. 3 and FIG. 5, the distance a of two inner-wall segments 33*a*, 33*b* of first cutout 33 that are diametrically opposed in the circumferential direction preferably corresponds to the distance b of two inner-wall segments 27*a*, 27*b* of second cutout 27 that are diametrically opposed in the same direction. In addition, it is apparent from FIG. 6 that second cutout 27 is preferably at least partially situated inside the projection of first cutout 33, in the sliding direction of armature 3. In other words, each of the two, first cutouts 23 somewhat overlaps its respective, assigned, second cutout 27, which is situated in a parallel plane. However, in departure from the exemplary embodiment represented here, distances a and b may also be selected to not be equal. In addition, just one first cutout and one second cutout may also be provided in place of the two first cutouts and the two second cutouts. In each case, it is also possible to provide more than two cutouts in the armature plate and the pole face of the magnet core. It is important that at least one first cutout radially offset from the axis of the armature pin be assigned to a second cutout in the pole face of the magnet core.

FIG. 7 shows a detail of a cross-section along line A—A in FIG. 6, where armature plate 31 was intentionally rotated about the axis of armature pin 31, out of the predetermined rotational position, so that the pole face 36 of armature plate 31 facing the magnet core and first cutout 33 partially overlap, and pole face 22 of magnet core 2 and second cutout 27 partially overlap. In this rotational position, it is apparent from FIG. 6 that, in response to a current being applied to solenoid coil 1, a magnetostatic force F, which drives armature plate 31 back into the predetermined rotational position, results from the now non-uniform, stray magnetic field (dotted lines in FIG. 6) in the region between inner-wall segments 33*a*, 33*b* of first cutout 33 and inner-wall segments 27*a*, 27*b* of second cutout 27. This is also true in the event of a small deviation in dimensions a and b. The repelling force adjusts armature plate 31 back to the predetermined rotational position, in which first cutouts 33 and second cutouts 27 mutually oppose each other. The restoring force is only equal to zero in this rotational position. Therefore, since magnetostatic restoring force F is even generated in response to the smallest angular movements of the armature plate, the armature plate is constantly being adjusted to the predetermined rotational position by the stray magnetic field. In this context, the adjustment of the armature plate is understood as the armature plate being virtually locked in its rotational position, up to the smallest, scarcely detectable, rotary oscillations, when the electromagnet is switched on. In any case, the rotational movements of the armature plate are so small that, when the electromagnet is switched on, the inner edges of opening 35 do not contact or only make minimal contact with connector elements 5 of solenoid coil 1, and the sliding motion of the armature during the opening or closing of the pressure-regulating valve is not impaired. When the electromagnet is switched off, the electrical connector elements of the solenoid coil, which pass through opening 35, prevent the armature plate from deflecting sharply, so that when the electromagnet is reactivated, the armature plate is immediately readjusted to the predetermined rotational position.

In the exemplary embodiment depicted up to this point, the armature plate and the pole face of the magnet core each have two cutouts. Another exemplary embodiment may provide for the number of first cutouts in the armature plate and second cutouts in the pole face of the magnet core being increased to the point where, regardless of the starting position of the armature plate, the magnetic adjustment brought about in response to switching on the electromagnet always adjusts to a preferred rotational position, in which the first cutouts and the second cutouts assigned to the first lots are diametrically opposed. In particular, the number and circumferential length of first cutouts 33 of armature plate 31 may equal the number and circumferential length a of the pole-face segments of armature plate 31, which separate the first cutouts from each other. A corresponding number of second cutouts 27 having the same circumferential length (b=a) is then provided in the magnet core. Such a design of the armature plate and the magnet core is particularly suitable for solenoid valves, in which no connector elements pass through the armature plate.

The number of diametrically opposed cutouts is proportional to adjusting force F of the armature plate. This number may therefore be selected to yield the magnitude of the restoring force F required in the individual case.

Although the present invention is represented here, using a pressure-regulating valve as an example, it may also be used in other solenoid valves. For example, it is conceivable to use the present invention in solenoid valves of injection valves for injection systems, in order to prevent the cross-section of the outlet passages, which are provided in the armature plate for discharging fuel, from becoming smaller due to a rotation of the armature plate. However, the operating principle of the electromagnet and armature plate represented here is not limited to use in solenoid valves, but may advantageously be used in all electromagnets, where it is useful to adjust an armature plate supported so as to be able to slide and rotate, to a preferred rotational position.

What is claimed is:

1. An electromagnet, comprising:

a solenoid coil;

a magnet core that passes through the solenoid coil and that has at least one pole face;

an armature that is supported perpendicularly to the at least one pole face of the magnet core so as to be able to slide;

an armature plate;

an armature pin that projects from the armature plate and that is supported so as to be able to slide and rotate, the armature plate facing the at least one pole face and the armature pin; and an adjusting arrangement formed on at least one of the electromagnet and the armature and for adjusting the armature plate to a predetermined rotational position, wherein:

the adjusting arrangement includes:

at least one first cutout that is radially offset from the armature pin and formed in the armature plate, and at least one second cutout that is situated in the least one pole face and assigned to the at least one first cutout, and the at least one second cutout magnetically interacts with the at least one first cutout in response to the solenoid coil being acted upon by a current, such that the armature plate is adjusted to the predetermined rotational position.

2. The electromagnet as recited in claim 1, wherein:

the electromagnet is for use in a solenoid valve.

3. The electromagnet as recited in claim 1, wherein:

a first distance of two inner-wall segments of the at least one first cutout approximately corresponds to a second distance of two inner-wall segments of the at least one second cutout, the two inner-wall segments of the at least one first cutout are diametrically opposed in a circumferential direction, and the two inner-wall segments of the at least one second cutout are diametrically opposed in a same direction.

4. The electromagnet as recited in claim 1, wherein:

the at least one second cutout is at least partially situated inside a projection of the at least one first cutout in a sliding direction of the armature.

5. The electromagnet as recited in claim 1, wherein:

the at least one first cutout includes two first cutouts that are diametrically opposed with respect to an axis of the armature pin, and the at least one second cutout includes two second cutouts that are assigned to the two first cutouts and are diametrically opposed with respect to the axis of the armature pin.

6. The electromagnet as recited in claim 1, wherein:

in the predetermined rotational position of the armature plate, electrical connector elements of the solenoid coil pass from a side of the armature plate opposite to the solenoid coil, through an opening of the armature plate, without touching the armature plate.

7. The electromagnet as recited in claim 1, wherein:

the at least one first cutout includes a plurality of first cutouts, the at least one second cutout includes a plurality of second cutouts, the at least one pole-face includes a plurality of pole face segments, a number and a circumferential length of the first cutouts are equal to a number and a circumferential length of the pole-face segments, the pole face segments separate the first cutouts from each other, and the magnet core includes a corresponding number of the second cutouts possessing the same circumferential length.

8. The electromagnet as recited in claim 1, wherein:

the at least one first cutout includes a plurality of first cutouts, the at least one second cutout includes a plurality of second cutouts, a number and a circumferential length of the first cutouts and of the second cutouts are adjusted to a magnitude of a restoring force.

9. A solenoid valve for a fuel-injection system, comprising:

an electromagnet, including:

a solenoid coil;

a magnet core that passes through the solenoid coil and that has at least one pole face;

an armature that is supported perpendicularly to the at least one pole face of the magnet core so as to be able to slide;

an armature plate;

an armature pin that projects from the armature plate and that is supported so as to be able to slide and rotate, the armature plate facing the at least one pole face and the armature pin; and an adjusting arrangement formed on at least one of the electromagnet and the armature and for adjusting the armature plate to a predetermined rotational position, wherein:

the adjusting arrangement includes:

at least one first cutout that is radially offset from the armature pin and formed in the armature plate, and at least one second cutout that is situated in the least one pole face and assigned to the at least one first cutout, and the at least one second cutout magnetically interacts with the at least one first cutout in response to the solenoid coil being acted upon by a current, such that the armature plate is adjusted to the predetermined rotational position.

* * * * *